US010599070B2

(12) United States Patent
Suenami

(10) Patent No.: US 10,599,070 B2
(45) Date of Patent: Mar. 24, 2020

(54) DEVELOPING DEVICE AND IMAGE FORMING APPARATUS THEREWITH TO PREVENT DEGRADATION IN CHARGING PERFORMANCE

(71) Applicant: KYOCERA Document Solutions Inc., Osaka (JP)

(72) Inventor: Koji Suenami, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/415,639

(22) Filed: May 17, 2019

(65) Prior Publication Data

US 2020/0019090 A1 Jan. 16, 2020

(30) Foreign Application Priority Data

Jul. 11, 2018 (JP) ..... 2018-131321

(51) Int. Cl.
*G03G 15/08* (2006.01)

(52) U.S. Cl.
CPC ..... *G03G 15/0891* (2013.01); *G03G 15/0812* (2013.01); *G03G 15/0853* (2013.01); *G03G 15/0889* (2013.01); *G03G 2215/0827* (2013.01)

(58) Field of Classification Search
CPC ..... G03G 15/0887; G03G 15/0889; G03G 15/0891; G03G 15/0893; G03G 15/0848; G03G 15/0849; G03G 15/0853
USPC ..... 399/27, 30, 254–257
See application file for complete search history.

(56) References Cited

U.S. PATENT DOCUMENTS 9,405,230 B2 * 8/2016 Akedo ..... G03G 15/0893
10,365,581 B1 * 7/2019 Hamakawa et al. ..... G03G 15/0893

FOREIGN PATENT DOCUMENTS

JP 2014-26129 A 2/2014

* cited by examiner

*Primary Examiner* — William J Royer
(74) *Attorney, Agent, or Firm* — Stein IP, LLC

(57) ABSTRACT

A developing device includes a developer container, a developer carrier, first and second stirring/transporting members, a driving motor, first and second magnetic permeability sensors, and a control portion. The first magnetic permeability sensor is arranged in a first conveying chamber in the developer container, in a region other than a part facing a communication portion and senses the toner concentration in developer in the developer container. The second magnetic permeability sensor is arranged in a second conveying chamber in the developer container, in a region between a regulating portion and a downstream end of the developer carrier in the second direction. The control portion controls the supply amount of developer based on the output value of the first magnetic permeability sensor, and calculates the stable volume of developer in the developer container based on the difference between the output values of the first and second magnetic permeability sensors.

6 Claims, 9 Drawing Sheets

DEVELOPING DEVICE AND IMAGE FORMING APPARATUS THEREWITH TO PREVENT DEGRADATION IN CHARGING PERFORMANCE

INCORPORATION BY REFERENCE

This application is based upon and claims the benefit of priority from the corresponding Japanese Patent Application No. 2018-131321 filed on Jul. 11, 2018, the entire contents of which are incorporated herein by reference.

BACKGROUND

The present disclosure relates to developing devices used in image forming apparatuses employing electrophotography such as copiers, printers, facsimile machines, and multifunction peripherals incorporating their functions, and to image forming apparatuses provided with such a developing device. More particularly, the present disclosure relates to developing devices which supply two-component developer containing toner and carrier and which discharge excessive developer, and to image forming apparatuses provided with such a developing device.

In image forming apparatuses, a latent image formed on an image carrier composed of a photosensitive member or the like is developed by a developing device and visualized as a toner image. In one type of such developing devices, a two-component development system using two-component developer is adopted. This type of developing device stores in a developer container two-component developer (hereinafter also referred to simply as developer) containing carrier and toner, includes a developing roller for supplying developer to the image carrier, and includes a stirring/conveying member which supplies developer in the developer container, while conveying and stirring it, to the developing roller.

In the developing device using a two-component development system, while toner is consumed as development is performed, carrier remains in the developing device unconsumed. Thus, carrier which is stirred together with toner in the developer container degrades as the stirring frequency increases. As a result, charging performance of carrier with respect to toner gradually degrades.

To cope with that, a developing device is proposed which can prevent degradation in charging performance by supplying developer containing carrier to the developer container while discharging excessive developer.

Incidentally, the height of developer tends to decrease in a high humidity environment and to increase in a low humidity environment. This causes the weight of developer in the developer container to vary depending on the environment in which the image forming apparatus is used. As a result, when the environment changes from a high humidity one to a low humidity one, the discharge amount of developer may increase suddenly or when the environment changes from a low humidity one to a high humidity one, developing failure may occur due to an insufficient height of developer.

For example, a known developing device employs, as a method for sensing trouble such as degradation of toner in developer, a decline in the storage amount of developer, or a deterioration in the balance of the proportion between toner and carrier, one involving sensing, with two magnetic permeability sensors arranged in the developer container, trouble with developer based on the difference between the outputs of the two magnetic permeability sensors.

SUMMARY

According to one aspect of the present disclosure, a developing device is provided with a developer container, a developer carrier, a first stirring/transporting member, a second stirring/transporting member, a driving motor, a first magnetic permeability sensor, a second magnetic permeability sensor, and a control portion. The developer container includes a plurality of conveying chambers including a first conveying chamber and a second conveying chamber which are arranged parallel to each other, a communication portion which makes the first and second conveying chambers communicate with each other at both ends of the first and second conveying chambers in their longitudinal direction, a developer supply port through which two-component developer containing carrier and toner is supplied, and a developer discharging portion which is provided at a downstream-side end part of the second conveying chamber and through which excessive developer is discharged. The developer carrier is rotatably supported on the developer container, and carries, on its surface, the developer in the second conveying chamber. A first stirring/conveying member is composed of a rotary shaft and a first conveying blade formed on the outer circumferential surface of the rotary shaft, and stirs and conveys developer in the first conveying chamber in a first direction. A second stirring/conveying member stirs and conveys developer in the second conveying chamber in a second direction opposite to the first direction. The second stirring/conveying member includes a rotary shaft, a second conveying blade which is formed on the outer circumferential surface of the rotary shaft, a regulating portion which is formed adjacent to the second conveying blade on its downstream side in the second direction and which is composed of a conveying blade for conveying developer in the direction opposite to the second conveying blade, and a discharging blade which is formed adjacent to the regulating portion on its downstream side in the second direction and which conveys developer in the same direction as the second conveying blade to discharge developer from the developer discharge portion. The driving motor drives the first stirring/conveying member and the second stirring/conveying member. The first magnetic permeability sensor is arranged in the first conveying chamber, in a region other than its part facing a communication portion and senses the toner concentration in developer in the developer container. The second magnetic permeability sensor is arranged in the second conveying chamber in the developer container, in a region between a regulating portion and a downstream-side end part of the developer carrier in the second direction. The control portion controls, based on an output value of the first magnetic permeability sensor, the supply amount of developer from the developer supply port so that the toner concentration in the developer in the developer container equals the reference toner concentration, and calculates, based on the difference between the output values of the first and second magnetic permeability sensors, the stable volume of developer in the developer container.

This and other objects of the present disclosure, and the specific benefits obtained according to the present disclosure, will become apparent from the description of embodiments which follows.

DETAILED DESCRIPTION

Figure 1:
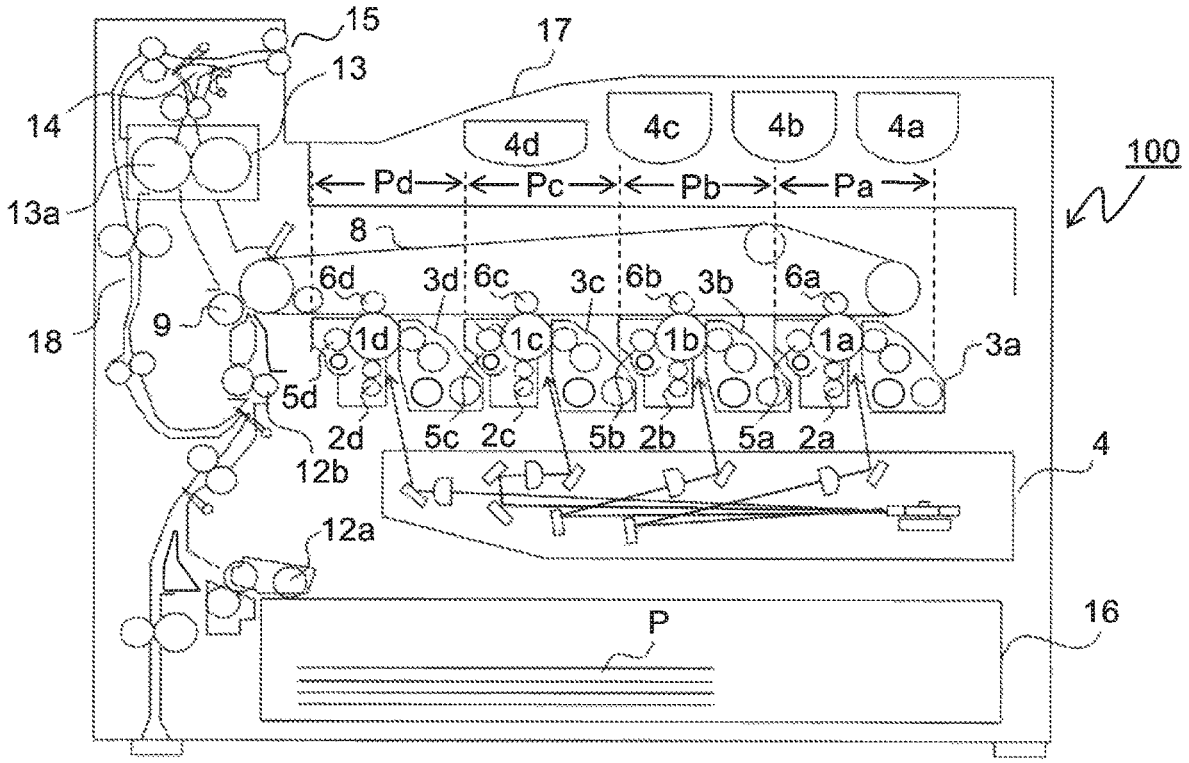
FIG. 1 is a schematic sectional view showing a color printer mounted with a developing device according to the present disclosure.

Hereinafter, with reference to the accompanying drawings, embodiments of the present disclosure will be described. FIG. 1 is a schematic sectional view showing an image forming apparatus incorporating developing devices 3*a* to 3*d* according to the present disclosure. Here, a tandem-type color printer 100 is illustrated. In a main body of the color printer 100, four image forming portions, Pa, Pb, Pc and Pd are arranged in this order from an upstream side in a conveying direction (from the right side in FIG. 1). These image forming portions Pa to Pd are provided so as to correspond to images of four different colors (cyan, magenta, yellow, and black) and sequentially form images of cyan, magenta, yellow, and black through the processes of electrostatic charge, exposure, developing and transfer.

In these image forming portions Pa to Pd, photosensitive drums 1*a*, 1*b*, 1*c*, and 1*d* are respectively arranged which carry visible images (toner images) of different colors. Further, an intermediate transfer belt 8 which rotates in the clockwise direction in FIG. 1 is provided adjacent to the image forming portions Pa to Pd.

When image data is input from a host device such as a personal computer, first, the surfaces of the photosensitive drums 1*a* to 1*d* are electrostatically charged uniformly by charging devices 2*a* to 2*d*. Next, an exposure device 4 irradiates the photosensitive drums 1*a* to 1*d* with light based on image data to form on them electrostatic latent images reflecting the image data. A predetermined amount of two-component developer (hereinafter also referred to simply as developer) containing cyan, magenta, yellow, and black toner is charged to the developing devices 3*a* to 3*d* from containers 4*a* to 4*d*. The developing devices 3*a* to 3*d* feed the photosensitive drums 1*a* to 1*d* with toner in the developer, which electrostatically adheres to the photosensitive drums 1*a* to 1*d*. In this way, toner images corresponding to the electrostatic latent images formed through exposure to light from the exposure device 4 are formed.

Then, by primary transfer rollers 6*a* to 6*d*, electric fields with a predetermined transfer voltage are applied between the primary transfer rollers 6*a* to 6*d* and the photosensitive drums 1*a* to 1*d*, and the cyan, magenta, yellow, and black toner images on the photosensitive drums 1*a* to 1*d* are primarily transferred to the intermediate transfer belt 8. Toner and the like left after the primary transfer on the surface of the photosensitive drums 1*a* to 1*d* is removed by cleaning devices 5*a* to 5*d*.

A transfer paper P to which a toner image is to be transferred is stored in a sheet cassette 16 arranged in a lower part in the color printer 100. The transfer paper P is conveyed via a sheet feeding roller 12*a* and a registration roller pair 12*b* to, with predetermined timing, a nip portion (secondary transfer nip portion) between a secondary transfer roller 9 provided adjacent to the intermediate transfer belt 8 and the intermediate transfer belt 8. The transfer paper P on which a toner image has been secondarily transferred is conveyed to a fixing portion 13.

The transfer paper P conveyed to the fixing portion 13 is heated and pressed by a fixing roller pair 13*a*, and thereby the toner image is fixed on the surface of the transfer paper P to form a predetermined full-color image. The transfer paper P on which a full-color image is formed is directly (or after being directed to a reversing conveying passage 18 by a branch portion 14 to have images formed on both its faces) discharged to a discharge tray 17 by a discharge roller pair 15.

Figure 2:
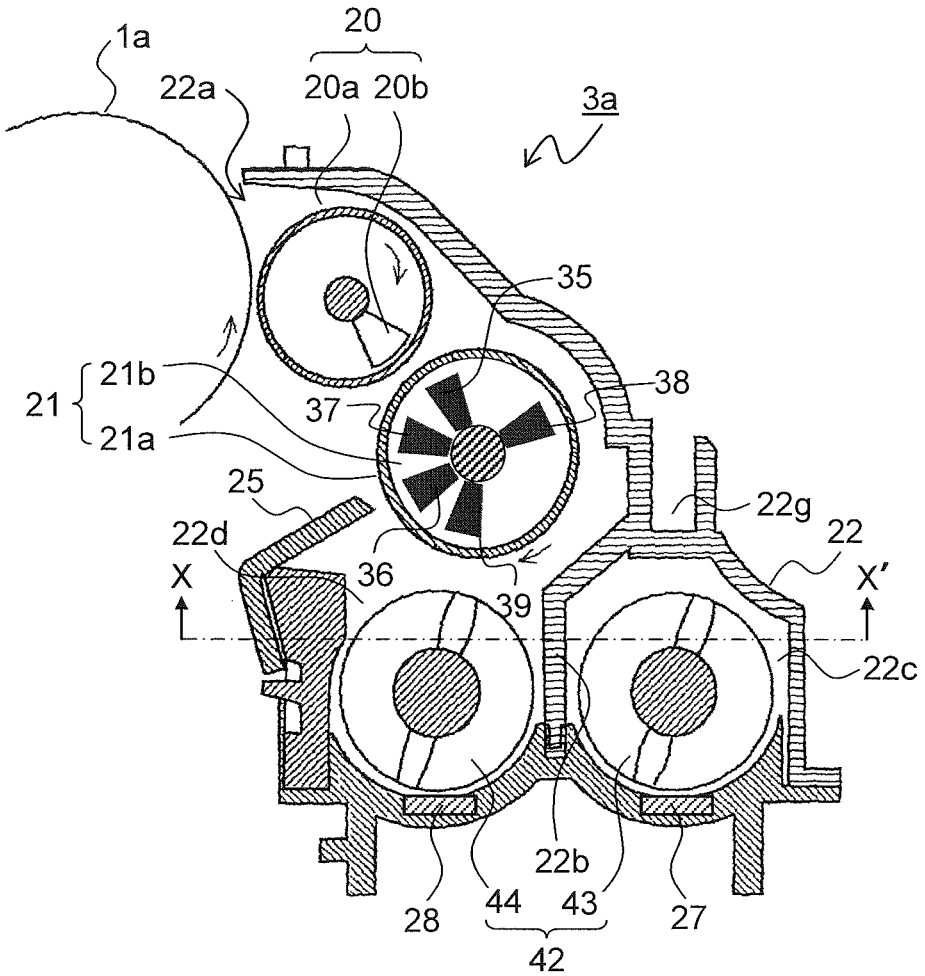
FIG. 2 is a side sectional view of the developing device according to one embodiment of the present disclosure.

FIG. 2 is a side sectional view showing the structure of the developing device 3*a* incorporated in the color printer 100. Here, a description will be given of the developing device 3*a* arranged in the image forming portion Pa in FIG. 1. The structure of the developing devices 3*b* to 3*d* arranged in the image forming portions Pb to Pd are basically similar to that of the developing device 3*a*, and thus no overlapping description will be repeated.

As shown in FIG. 2, the developing device 3*a* is provided with a developer container 22 in which two-component developer is stored. In the developer container 22, an opening 22*a* is formed through which a developing roller 20 is exposed toward the photosensitive drum 1*a*. The developer container 22 is partitioned into first and second conveying chambers 22*c* and 22*d* by a partition wall 22*b*. In the first and second conveying chambers 22*c* and 22*d*, there is rotatably arranged a stirring/conveying member 42 composed of first and second stirring screws 43 and 44 for stirring toner (positively charged toner) and carrier fed from the container 4*a* (see FIG. 1) to electrostatically charge the toner.

The developer is, while being stirred by the first and the second stirring screws 43 and 44, conveyed in the axial direction and, via communication portions 22*e* and 22*f* (see FIG. 3) formed at both ends of the partition wall 22*b*, circulates between the first and second conveying chambers 22*c* and 22*d*. In the illustrated example, the developer container 22 extends obliquely to the upper left, and above the second stirring screw 44 in the developer container 22, a magnetic roller 21 is arranged. Obliquely to the upper left of the magnetic roller 21, the developing roller 20 is arranged so as to face the magnetic roller 21. The developing roller 20, at the opening 22*a* side (left side in FIG. 2) of the developer container 22, faces the photosensitive drum 1*a*, and the magnetic roller 21 and the developing roller 20 rotate in the clockwise direction in FIG. 2.

The magnetic roller 21 is composed of a non-magnetic rotary sleeve 21*a* and a fixed magnet body 21*b* arranged inside the rotary sleeve 21*a* and having a plurality of magnetic poles. In this embodiment, the fixed magnet body 21*b* has five magnetic poles, namely, a main pole 35, a regulating pole (magnetic pole for trimming) 36, a conveyance pole 37, a peeling pole 38, and a scooping pole 39. The magnetic roller 21 and the developing roller 20 face each other across a predetermined gap at the position at which they face each other (a facing position).

To the developer container 22, a trimming blade 25 is fitted along the longitudinal direction of the magnetic roller 21 (the direction perpendicular to the plane in FIG. 2). The trimming blade 25 is positioned upstream, in the rotating direction of the magnetic roller 21 (the clockwise direction in FIG. 2), of the position at which the developing roller 20 and the magnetic roller 21 face each other. Between the tip end portion of the trimming blade 25 and the surface of the magnetic roller 21, a small clearance (gap) is formed.

The developing roller 20 is composed of a non-magnetic developing sleeve 20*a* and a developing roller-side magnetic pole 20*b* fixed inside the developing sleeve 20*a*. The developing roller-side magnetic pole 20*b* has a polarity different from that of the opposite magnetic pole (main pole) 35 of the fixed magnet body 21*b*.

Figure 5:
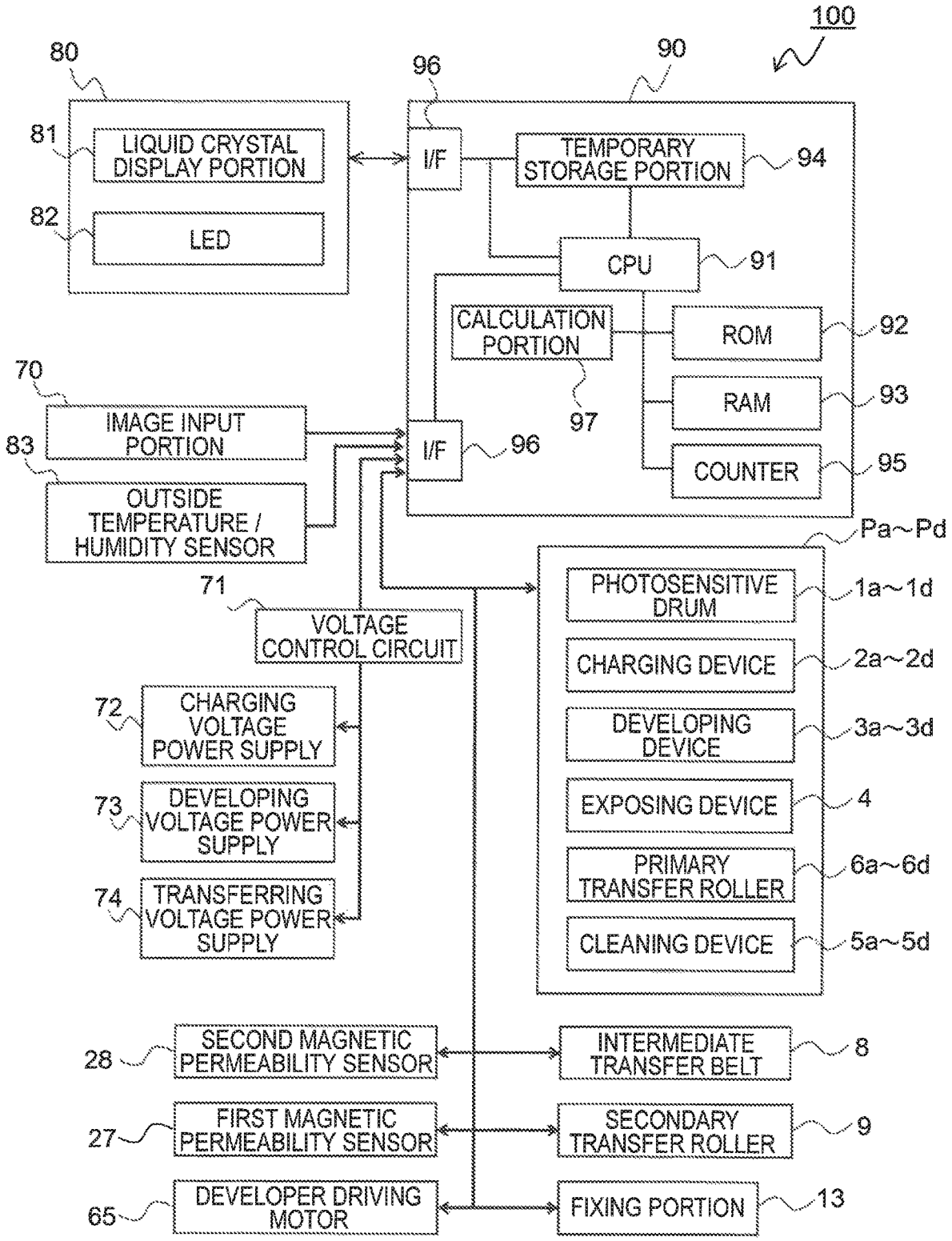
FIG. 5 is a block diagram showing one example of control paths in the color printer.

To the developing device 3*a*, a developing voltage power supply 73 is connected via a voltage control circuit 71 (see FIG. 5 for both). The developing voltage power supply 73 applies to the developing roller 20 a direct-current voltage (hereinafter called Vslv (DC)) and an alternating-current voltage (hereinafter called Vslv (AC)). The developing voltage power supply 73 applies to the magnetic roller 21 a direct-current voltage (hereinafter, called Vmag (DC)) and an alternating-current voltage (hereinafter, called Vmag (AC)).

On the bottom face of the first conveying chamber 22*c*, a first magnetic permeability sensor 27 is arranged so as to face the first stirring screw 43. The first magnetic permeability sensor 27 senses the magnetic permeability of the two-component developer composed of toner and magnetic carrier in the developer container 22, and senses the concentration of toner in the two-component developer (the mixture ratio of toner to carrier in the developer T/C). A control portion 90 (see FIG. 5) supplies developer to the developer container 22, in accordance with the toner concentration sensed by the first magnetic permeability sensor 27, from the container 4*a* (see FIG. 1) via a developer supply port 22*g* such that the toner concentration in the developer in the developer container 22 remains equal to the reference toner concentration. The first magnetic permeability sensor 27 is arranged in a region other than the portions facing the upstream-side communication portion 22*e* and the downstream-side communication portion 22*f* (see FIG. 3) in the first conveying chamber 22*c*.

On the bottom face of the second conveying chamber 22*d*, a second magnetic permeability sensor 28 is arranged so as to face the second stirring screw 44. As will be described later, based on the difference between the output values of a second magnetic permeability sensor 28 and a first magnetic permeability sensor 27, the amount of the developer in the developer container 22 is calculated. The second magnetic permeability sensor 28 is arranged upstream of and close to a regulating portion 52 (see FIG. 3) in the conveying direction of the developer in the second conveying chamber 22*d*.

As mentioned above, by the first and second stirring screws 43 and 44, the developer circulates, while being stirred, in the developer container 22 to electrostatically charge the toner, and by the second stirring screw 44, the developer is conveyed to the magnetic roller 21. The trimming blade 25 faces the regulating pole 36 of the fixed magnet body 21*b*. By using a non-magnetic body or a magnetic body with a polarity different from that of the regulating pole 36 as the trimming blade 25, a magnetic field is generated at the gap between the tip end of the trimming blade 25 and the rotary sleeve 21*a* in such a direction that these attract each other.

This magnetic field forms a magnetic brush between the trimming blade 25 and the rotary sleeve 21*a*. After having the layer thickness regulated by the trimming blade 25, the magnetic brush on the magnetic roller 21 moves to a position facing the developing roller 20; then a magnetic field is applied by the main pole 35 of the fixed magnet body 21*b* and the developing roller-side magnetic pole 20*b* such that these attract each other, and thus the magnetic brush makes contact with the surface of the developing roller 20. Then, the potential difference ΔV between the Vmag (DC) applied to the magnetic roller 21 and the Vslv (DC) applied to the developing roller 20 as well as the magnetic field cause a thin toner layer to be formed on the developing roller 20.

The layer thickness of the toner on the developing roller 20 changes also depending on the resistance of the developer, the difference in rotation speed between the magnetic roller 21 and the developing roller 20, and the like. This can be controlled by varying ΔV. When ΔV is increased, the toner layer on the developing roller 20 becomes thicker, and when ΔV is decreased, the toner layer on the developing roller 20 becomes thinner. The appropriate range of ΔV during development is, in general, about 100 V to 350 V.

The thin toner layer formed on the developing roller 20 by the magnetic brush is, as the developing roller 20 rotates, conveyed to a part where the photosensitive drum 1*a* and the developing roller 20 face each other. To the developing roller 20, the Vslv (DC) and Vslv (AC) are applied. Due to the potential difference from that on the photosensitive drum 1*a*, the toner flies, and an electrostatic latent image is developed on the photosensitive drum 1*a*.

When the rotary sleeve 21*a* rotates further in the clockwise direction, now, by a magnetic field in the horizontal direction (circumferential direction of the roller) generated by the peeling pole 38 with a different polarity, which is arranged adjacent to the main pole 35, the magnetic brush is taken away from the surface of the developing roller 20. The toner left unused for development is collected from the developing roller 20 on the rotary sleeve 21*a*. When the rotary sleeve 21*a* further rotates, a repelling magnetic field is applied by the peeling pole 38 and the scooping pole 39 with the same polarity in the fixed magnet body 21*b*, and thus the toner separates from the rotary sleeve 21*a* in the developer container 22. Then, after being stirred and conveyed by the second stirring screw 44, the two-component developer which has an appropriate toner concentration and which is electrostatically charged uniformly again forms the magnetic brush on the rotary sleeve 21*a* with the scooping pole 39 and is conveyed to the trimming blade 25.

Figure 3:
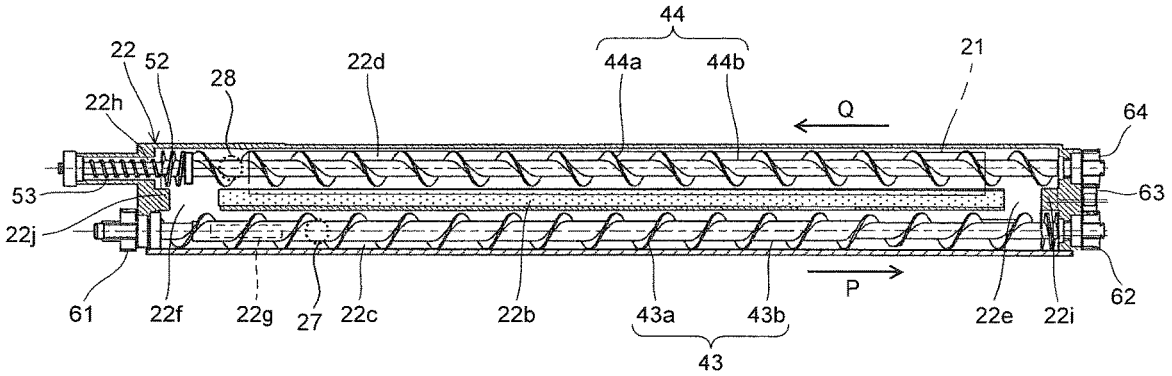
FIG. 3 is a sectional plan view showing a stirring portion of the developing device of this embodiment.
Figure 4:
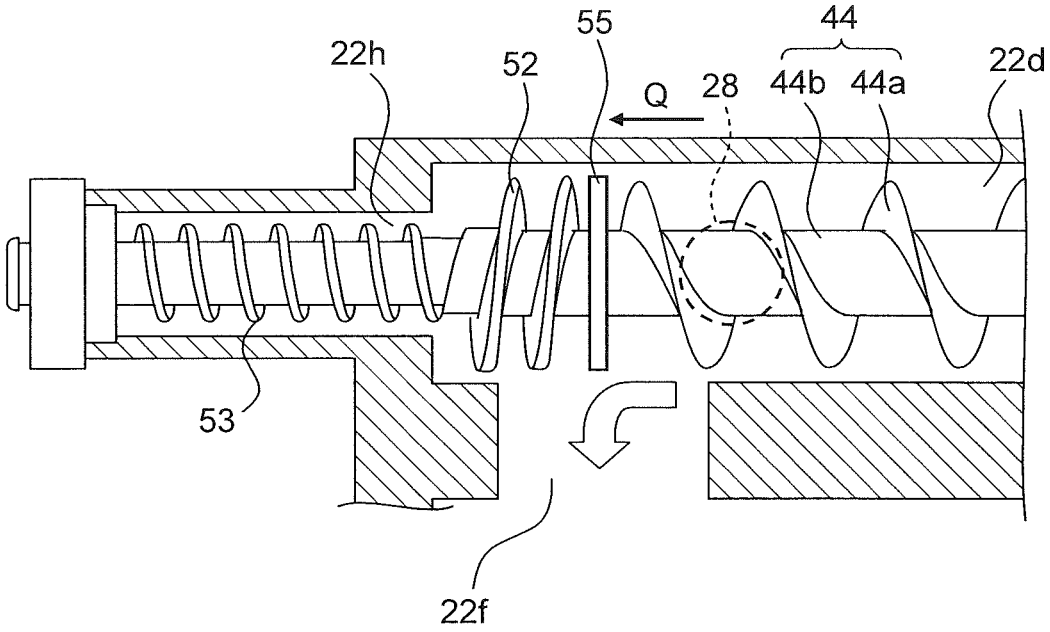
FIG. 4 is an enlarged view of and around a developer discharge portion in FIG. 3.

Next, the structure of a stirring portion of the developing device 3*a* will be described in detail. FIG. 3 is a sectional plan view (sectional view cut along line X-X' in FIG. 2 as seen from the direction of the arrows) showing a stirring portion of the developing device 3*a*. FIG. 4 is a partly enlarged view of and around a developer discharge portion 22*h* in FIG. 3.

Formed in the developer container 22 are, as described above, the first conveying chamber 22*c*, the second conveying chamber 22*d*, the partition wall 22*b*, the upstream-side communication portion 22*e*, and the downstream-side communication portion 22*f*. Additionally, there are also formed the developer supply port 22*g*, the developer discharge portion 22*h*, an upstream-side wall portion 22*i*, and a downstream-side wall portion 22*j*. It is assumed that, with respect to the first conveying chamber 22*c*, the left side in FIG. 3 is the upstream side and the right side in FIG. 3 is the downstream side, and that, with respect to the second conveying chamber 22*d*, the right side in FIG. 3 is the upstream side, and the left side in FIG. 3 is the downstream side. Accordingly, with respect to the communication portion and the wall portion, upstream side and downstream side denote those sides with respect to the second conveying chamber 22*d*.

The partition wall 22*b* extends in the longitudinal direction of the developer container 22 and partitions it into the first conveying chamber 22*c* and the second conveying chamber 22*d* such that they are located side by side. A right-side end part of the partition wall 22*b* in its longitudinal direction and the inner wall portion of the upstream-side wall portion 22*l* form the upstream-side communication portion 22*e*, while a left-side end part of the partition wall 22*b* in the longitudinal direction and the inner wall portion of the downstream-side wall portion 22*j* form the downstream-side communication portion 22*f*. The developer circulates inside the first conveying chamber 22*c*, the upstream-side communication portion 22*e*, the second conveying chamber 22*d*, and the downstream-side communication portion 22*f*.

The developer supply port 22*g* is an opening provided in an upper part of the developer container 22 for supplying new toner and carrier to the developer container 22 from the container 4*a* (see FIG. 1), and is arranged on the upstream side of the first conveying chamber 22*c* (on the left side in FIG. 3).

The developer discharge portion 22*h* discharges the developer which has become excessive in the first and second conveying chambers 22*c* and 22*d* due to the supply of the developer. The developer discharge portion 22*h* is provided on the downstream side of the second conveying chamber 22*d* continuously with the second conveying chamber 22*d* in its longitudinal direction.

The first stirring screw 43 has a rotary shaft 43*b* and a first helical blade 43*a* which is provided integrally with the rotary shaft 43*b*, and is formed in a helical shape with a predetermined pitch in the axial direction of the rotary shaft 43*b*. The first helical blade 43*a* extends to the both ends of the first conveying chamber 22*c* in its longitudinal direction and is provided so as to face the upstream-side and downstream-side communication portions 22*e* and 22*f*. The rotary shaft 43*b* is rotatably pivoted on the upstream-side and downstream-side wall portions 22*l* and 22*j* of the developer container 22.

The second stirring screw 44 has a rotary shaft 44*b* and a second helical blade 44*a* which is provided integrally with the rotary shaft 44*b*, and is formed in a helical shape with a blade winding in the direction opposite to (having the phase opposite to) the first helical blade 43*a* with the same pitch as the first helical blade 43*a* in the axial direction of the rotary shaft 44*b*. The second helical blade 44*a* is longer than the magnetic roller 21 in its axial direction, and is provided so as to extend up to a position where it faces the communication portion 22*e*. The rotary shaft 44*b* is arranged parallel to the rotary shaft 43*b* and is rotatably pivoted on the upstream-side and downstream-side wall portions 22*l* and 22*j* of the developer container 22.

To the rotary shaft 44*b*, in addition to the second helical blade 44*a*, the regulating portion 52 and a discharging blade 53 are integrally arranged.

The regulating portion 52 holds back the developer conveyed to the downstream side in the second conveying chamber 22*d* and conveys the developer exceeding a predetermined amount to the developer discharge portion 22*h*. The regulating portion 52 is composed of a helical blade provided on the rotary shaft 44*b*. This helical blade is formed in a helical shape with a blade winding in the direction opposite to (having the phase opposite to) the second helical blade 44*a*, has a substantially same outer diameter as the second helical blade 44*a*, and has a pitch smaller than that of the second helical blade 44*a*. The regulating portion 52 forms a predetermined clearance between the inner wall portion of the developer container 22 such as the downstream-side wall portion 22*j* and the outer circumferential part of the regulating portion 52. Excessive developer is conveyed to the developer discharge portion 22*h* through this clearance.

The rotary shaft 44*b* extends into the developer discharge portion 22*h*. On the rotary shaft 44*b* in the developer discharge portion 22*h*, the discharging blade 53 is provided. The discharging blade 53 is composed of a helical blade which winds in the same direction as the second helical blade 44*a* and which has a smaller pitch and a smaller blade outer circumference compared to the second helical blade 44*a*. As the rotary shaft 44*b* rotates, the discharging blade 53 rotates together. The excessive developer which has moved over the regulating portion 52 and has been conveyed into the developer discharge portion 22*h* is conveyed to the left side in FIG. 4 to be discharged to outside the developer container 22. The discharging blade 53, the regulating portion 52, and the second helical blade 44*a* are molded of synthetic resin integrally with the rotary shaft 44*b*.

On the outer wall of the developer container 22, gears 61 to 64 are arranged. The gears 61 and 62 are fixed to the rotary shaft 43*b*, and the gear 64 is fixed to the rotary shaft 44*b*. The gear 63 is rotatably supported on the developer container 22 and meshes with the gears 62 and 64.

As the gear 61 is rotated by a developer driving motor 65 (see FIG. 5), the first stirring screw 43 rotates. The developer in the first conveying chamber 22*c* is conveyed in the main conveying direction (first direction, arrow P direction) by the first helical blade 43*a*, and is then conveyed into the second conveying chamber 22*d* via the upstream-side communication portion 22*e*. As the second stirring screw 44 rotates via the gears 62 to 64, the developer inside the second conveying chamber 22*d* is conveyed by the second helical blade 44*a* in the main conveying direction (second direction, arrow Q direction). During developing during which no new developer is supplied, the developer is, while greatly changing its height, conveyed into the second conveying chamber 22*d* from the first conveying chamber 22*c* via the upstream-side communication portion 22*e*. Then, without moving over the regulating portion 52, the developer is conveyed via the communication portion 22*f* to the first conveying chamber 22*c*.

In this way, the developer is stirred while circulating from the first conveying chamber 22*c* to the upstream-side communication portion 22*e*, and then to the second conveying chamber 22*d*, and then to the downstream side communication portion 22*f*. The stirred developer is fed to the magnetic roller 21.

Next, a description will be given of a case where developer is supplied through the developer supply port 22*g*. As toner is consumed in development, the developer containing carrier is supplied from the developer supply port 22*g* to the first conveying chamber 22*c*.

The supplied developer is, as during development, conveyed inside the first conveying chamber 22*c* in the main conveying direction (arrow P direction) by the first stirring screw 43, and is then conveyed into the second conveying chamber 22*d* via the upstream-side communication portion 22*e*. Then, by the second stirring screw 44, the developer is conveyed inside the second conveying chamber 22*d* in the main conveying direction (arrow Q direction). When the regulating portion 52 rotates as the rotary shaft 44*b* rotates, a conveying force in the direction opposite to the main conveying direction (reverse conveying direction) is applied to the developer by the regulating portion 52. The developer is held back by the regulating portion 52 to bulk up, and the excessive developer (the same amount as the developer supplied from the developer supply port 22*g*) moves over the regulating portion 52 and is discharged outside the developer container 22 through the developer discharge portion 22*h*.

FIG. 4 is an enlarged view of and around the developer discharge portion 22*h* in FIG. 3. As shown in FIG. 4, in the second stirring screw 44, there is arranged a disk 55 between the second helical blade 44*a* and the regulating portion 52. The disk 55 is, together with the second helical blade 44*a*, the regulating portion 52, and the discharging blade 53, molded of synthetic resin integrally with the rotary shaft 44*b*.

The developer which is conveyed in the main conveying direction (arrow Q direction) by the second helical blade 44*a* is held back by the disk 55, and this momentarily weakens the conveying force of the developer. Then, a conveying force in the opposite direction is applied to the developer by the regulating portion 52, and the developer is pushed back in the direction opposite to the main conveying direction. That is, the disk 55 plays a role of reducing the conveying force (pressure) acting from the second conveying chamber 22*d* to the regulating portion 52. As a result, it is possible to prevent waving (fluctuation) at the surface of the developer which is moving to the regulating portion 52 and the downstream-side communication portion 22*f*, and thus, regardless of the conveying speed of the developer, a nearly constant amount of developer can be retained around the regulating portion 52.

Then, when the developer is supplied from the developer supply port 22*g* to increase the height of the developer in the developer container 22, the developer stagnating on the upstream side of the regulating portion 52 moves over the disk 55 and the regulating portion 52 to the discharging blade 53 (developer discharge portion 22*h*), and excessive developer is discharged from the developer discharge portion 22*h*. When the developer ceases to be discharged from the developer discharge portion 22*h*, the height of the developer in the developer container 22 is stabilized. The volume of the developer when its height is stabilized is referred to as a stable volume.

Next, control paths in the color printer 100 will be explained. FIG. 5 is a block diagram showing one example of control paths used in the color printer 100 of this embodiment. When the color printer 100 is used, different parts of the device are controlled in different manners, and thus the control paths in the whole color printer 100 are complicated. Thus, the following description focuses on those control paths which are essential for the implementation of the present disclosure.

Based on the control signal from the control portion 90, the developer driving motor 65 drives to rotate the developing roller 20, the magnetic roller 21, and the stirring/conveying member 42 in the developing devices 3*a* to 3*d*.

An image input portion 70 is a receiving portion for receiving image data transmitted to the color printer 100 from a personal computer and the like. The image signal input via the image input portion 70 is converted to a digital signal and is then transmitted to a temporary storage portion 94.

The voltage control circuit 71 is connected to a charging voltage power supply 72, the developing voltage power supply 73, and a transferring voltage power supply 74, and operates these power supplies according to an output signal from the control portion 90. In response to the control signal from the voltage control circuit 71, the charging voltage power supply 72, the developing voltage power supply 73, and the transferring voltage power supply 74 apply predetermined voltages respectively to the charging devices 2*a* to 2*d*, to the developing roller 20 and the magnetic roller 21 in the developing devices 3*a* to 3*d*, and to the primary transfer rollers 6*a* to 6*d* and the secondary transfer roller 9.

An operating portion 80 is provided with a liquid crystal display portion 81 and an LED 82. The liquid crystal display portion 81 and the LED 82 indicate the status of the color printer 100 and display the status of image formation and the number of print copies. Various settings for the color printer 100 are made by a printer driver on a personal computer.

An outside temperature/humidity sensor 83 senses the temperature and the humidity (relative humidity) in the installation environment (surrounding environment) of the color printer 100. The outside temperature/humidity sensor 83 is arranged at a position where it is less likely to be affected by the heat dissipated from the fixing portion 13 and the like in the color printer 100.

The control portion 90 is provided at least with a CPU (central processing unit) 91, a ROM (read-only memory) 92 which is a read-only storage portion, a RAM (random-access memory) 93 which is a readable-writable storage portion, the temporary storage portion 94 which temporarily stores image data and the like, a counter 95, a plurality of (here, two) I/Fs (Interfaces) 96 which sends control signals to different devices in the color printer 100 and receives input signals from the operating portion 80, and a calculation portion 97 which performs arithmetic operations necessary for control. The control portion 90 can be arranged at any place inside the main body of the color printer 100.

The control portion 90 transmits control signals to different parts and devices in the color printer 100 from the CPU 91 through the I/F 96. From the different parts and devices, signals that indicate their statuses and input signals are transmitted through the I/F 96 to the CPU 91. The different parts and devices controlled by the control portion 90 include, for example, the image forming portions Pa to Pd, the fixing portion 13, the first magnetic permeability sensor 27, the second magnetic permeability sensor 28, the image input portion 70, the voltage control circuit 71, and the operating portion 80.

The I/F 96 performs wired and wireless data communication with external devices such as a personal computer via a communication network such as the internet and a LAN.

The ROM 92 stores data and the like that are not changed during the use of the color printer 100, such as control programs for the color printer 100 and values needed for control. The RAM 93 stores necessary data generated while the color printer 100 is controlled, data temporarily needed to control the color printer 100, and the like. For example, the RAM 93 (or ROM 92) stores a plurality of reference toner concentrations which serve as indices during the supply of developer to the developing devices 3*a* to 3*d*. The RAM 93 (or ROM 92) also stores the relationship, with the stable volume of developer, of the difference between the output values of the first and second magnetic permeability sensors 27 and 28 for use in calculation of the stable volume of developer as will be described later. The counter 95 counts the number of printed sheets in a cumulative manner.

The calculation portion 97 calculates the toner concentration in the developing devices 3*a* to 3*d* from the output value of the first magnetic permeability sensor 27 to decide the amount of developer to be supplied to the developing devices 3*a* to 3*d*. The determined supply amount is transmitted to the CPU 91. Based on the difference between the output values of the first and second magnetic permeability sensors 27 and 28, the calculation portion 97 calculates the stable volume of the developer in the developing devices 3*a* to 3*d*. The calculation portion 97 calculates the amount of developer to be discharged forcibly (the rotation speed and the rotation time of the stirring/conveying member 42) when the stable volume is judged to be larger than a predetermined value.

Next, a description will be given of a method for calculating the stable volume of developer in the developer container 22 using the first and second magnetic permeability sensors 27 and 28. A magnetic permeability sensor measures the toner concentration by measuring the proportion of carrier in the developer. However, when the height (volume) of developer which is present above the magnetic permeability sensor increases, the developer is compressed by its own weight to increase the concentration of carrier in the developer. Thus, even if the proportions of the carrier and the toner in the developer are constant, the output value of the sensor is larger.

To cope with that, the first and second magnetic permeability sensors 27 and 28 are arranged, respectively, at a place where the change in the output value is small even if the stable volume of developer changes and at a place where the output value changes according to the change in the stable volume of developer in the developer container 22. Then, by sensing the difference between the sensor output values of the first and second magnetic permeability sensors 27 and 28, the height (volume) of the developer in the developer container 22 can be inferred.

Also, the larger the amount of change in the difference between the sensor output values with respect to the amount of change in the stable volume of developer, the easier the detection of the change in the stable volume. For determining the optimum arrangement of the first and second magnetic permeability sensors 27 and 28, magnetic permeability sensors are arranged in regions A to F in the developer container 22 shown in FIG. 6 to check the change in the sensor output values when the stable volume of the developer is changed.

The region A is a region between the disk 55 in the second conveying chamber 22*d* and an end part of the magnetic roller 21, and it is a range extending from the disk 55 by one pitch of the second helical blade 44*b* of the second stirring screw 44. The region B is a region facing the downstream-side communication portion 22*f* of the first conveying chamber 22*c*, and it is a part of the first conveying chamber 22*c* where it receives developer from the second conveying chamber 22*d*. The region C is a region facing the upstream-side communication portion 22*e* of the first conveying chamber 22*c*, and it is a part in the first conveying chamber 22*c* from which developer is conveyed to the second conveying chamber 22*d*.

The region D is a region in the first conveying chamber 22*c* excluding the regions B and C. The region E is a region facing the upstream-side communication portion 22*e* of the second conveying chamber 22*d*, and it is a part where the second conveying chamber 22*d* receives developer from the first conveying chamber 22*c*. The region F is a region in the second conveying chamber 22*d* excluding the regions A and E, and it is a part facing the magnetic roller 21.

Figure 6:
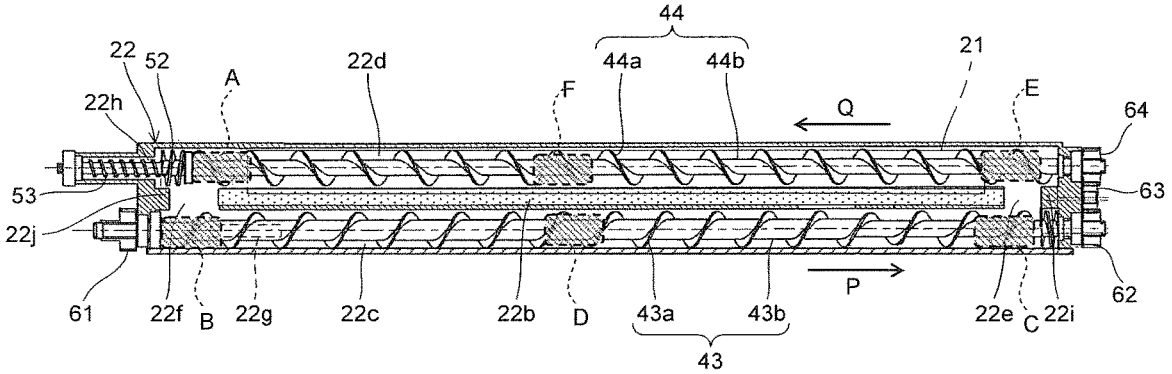
FIG. 6 is a sectional plan view showing the stirring portion of the developing device of this embodiment, illustrating regions A to F for checking the relationship of a stable volume of developer with the sensor output value according to an arrangement of the magnetic permeability sensors.
Figure 7:
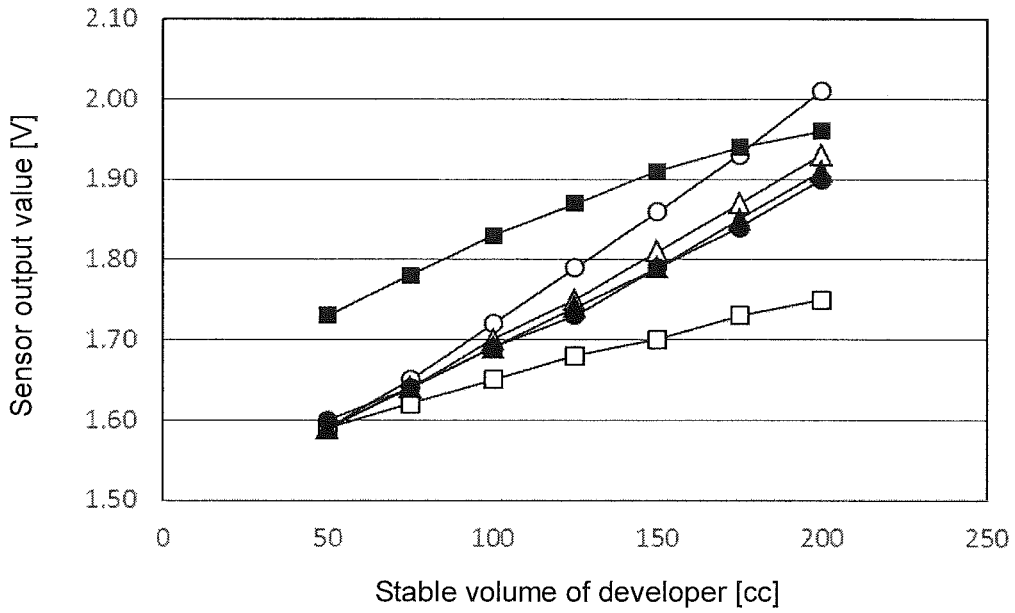
FIG. 7 is a graph showing the relationship, with the sensor output value, of the stable volume of developer when the magnetic permeability sensors are arranged in regions A to F in FIG. 6.

FIG. 7 is a graph showing the relationship, with the sensor output values, of the stable volume of developer when the magnetic permeability sensors are arranged in the regions A to F in FIG. 6. As shown in FIG. 7, in the region A (the series of data indicated by hollow circles), the larger the stable volume of developer, the higher the sensor output value. This is because the conveying speed of developer is slower in the region A which is close to the upstream side of the regulating portion 52 and the disk 55 and developer is likely to stagnate with respect to the change in the volume of developer.

Also in the region B (the series of data indicated by hollow triangles), the region C (the series of data indicated by solid circles), and the region E (the series of data indicated by solid triangles), there is similar tendency as in the region A, but compared to in the region A, developer is less likely to stagnate, and thus the change in the sensor output value is smaller than in the region A. By contrast, in the region D (the series of data indicated by hollow squares), developer is less likely to stagnate, and thus, even if the stable volume of developer increases, the sensor output value does not increase much. The region F (the series of data indicated by solid squares) faces the magnetic roller 21 and thus it is affected by the magnetism of the magnetic roller 21. This results in the overall higher sensor output, and thus the output values are not reliable.

From the above results, it can be seen that, by arranging the first magnetic permeability sensor 27 in the region D and the second magnetic permeability sensor 28 in the region A, it is possible to maximize the difference between the sensor output values, and thereby to sense the change in the stable volume of developer accurately.

Next, a method for calculating the stable volume of developer will be explained. The difference between the sensor output values of the first and second magnetic permeability sensors 27 and 28 changes according to the flowability of developer. More specifically, depending on whether the flowability of developer is high or low, the compressed state of developer with respect to the magnetic permeability sensor changes, and the gradient of the graph is different.

Figure 8:
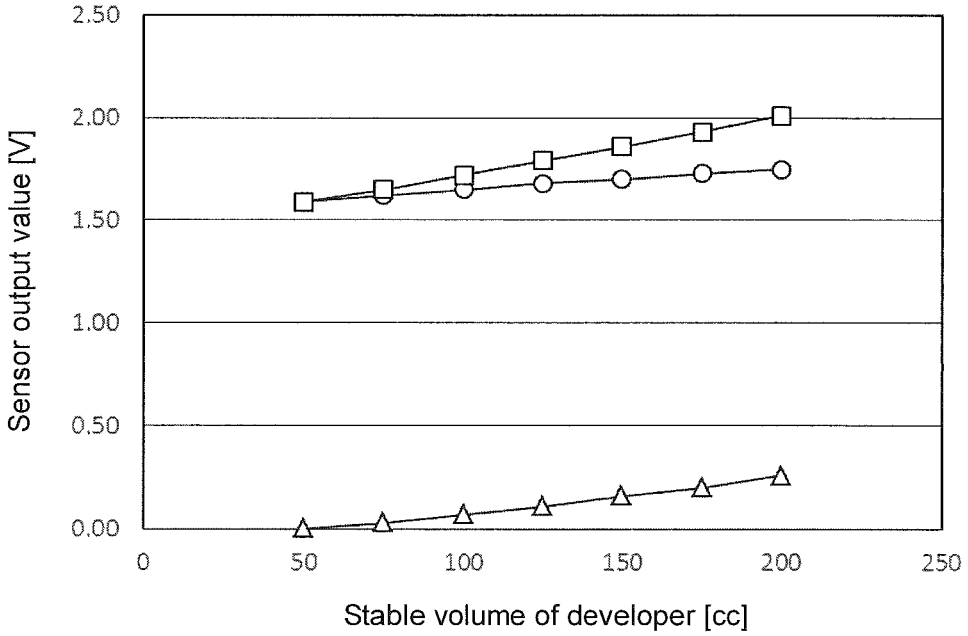
FIG. 8 is a graph showing a relationship of a stable volume of a developer with the sensor output values of the first and second magnetic permeability sensors under Condition 1 in which flowability of developer is high.
Figure 9:
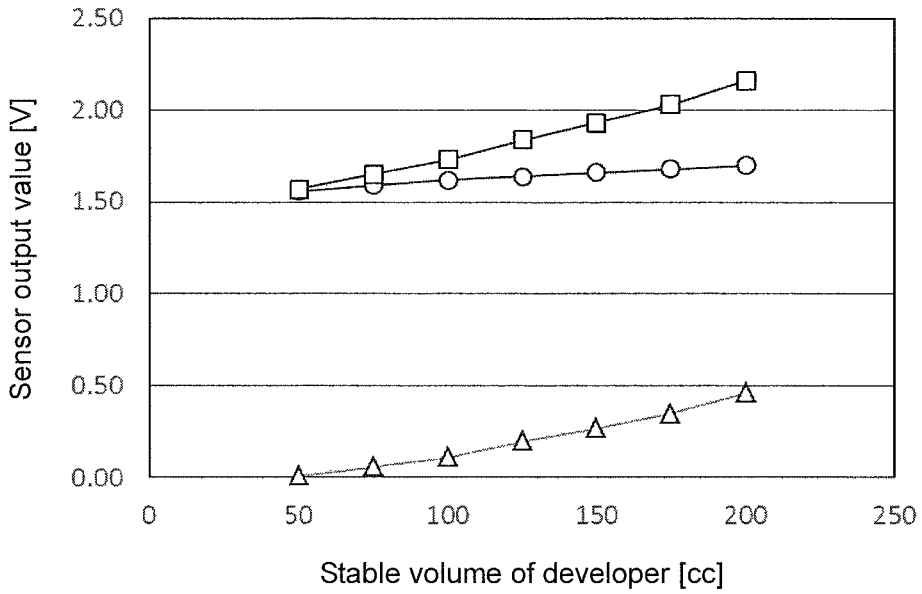
FIG. 9 is a graph showing a relationship of the stable volume of developer with a sensor output values of the first and second magnetic permeability sensors under Condition 2 in which flowability of developer is low.

FIGS. 8 and 9 are graphs showing the relationship, with the stable volume of developer, of the output values of the first and second magnetic permeability sensors 27 and 28, respectively illustrating a case where the flowability of developer is high and a case where it is low. As shown in FIG. 8, under a condition where the flowability of developer is high (hereinafter called Condition 1), the difference between the gradients of the sensor output values between the first magnetic permeability sensor 27 (the series of data indicated by hollow circles) and the second magnetic permeability sensor 28 (the series of data indicated by hollow squares) is small. Thus, the gradient of the difference between the sensor output values (the series of data indicated by hollow triangles) is also small.

On the other hand, as shown in FIG. 9, under a condition where the flowability of developer is low (hereinafter called Condition 2), the difference between the gradients of the sensor output values between the first magnetic permeability sensor 27 (the series of data indicated by hollow circles) and of the sensor output value of the second magnetic permeability sensor 28 (the series of data indicated by hollow squares) is large. Thus, the gradient of the difference between the sensor output values (the series of data indicated by hollow triangles) is also large.

Figure 10:
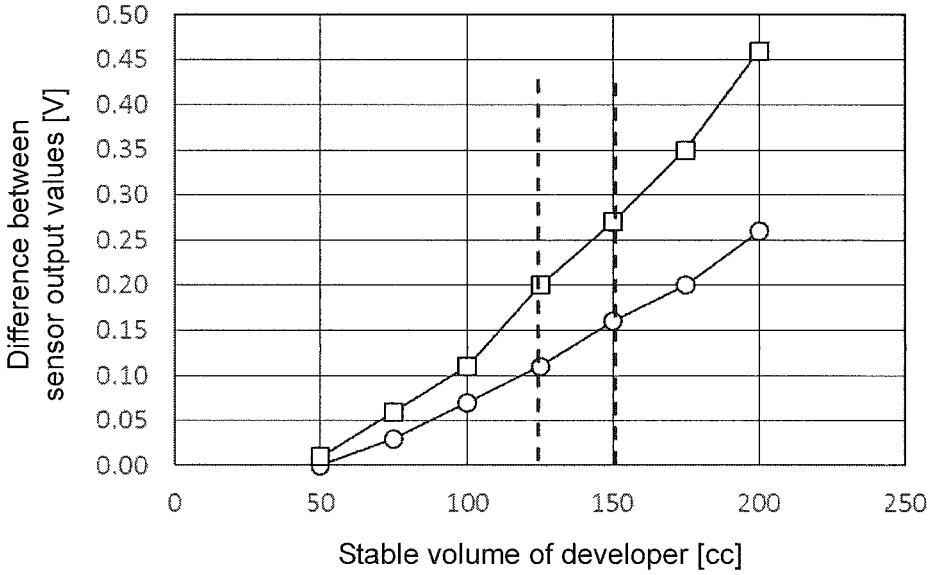
FIG. 10 is a graph showing the relationship of the stable volume of developer with the difference between the sensor output values of the first and second magnetic permeability sensors under Conditions 1 and 2.

FIG. 10 is a graph showing a relationship of the stable volume of the developer with the difference between the sensor output values of the first and second magnetic permeability sensors 27 and 28 under Conditions 1 and 2. For example, in a case where the stable volume of developer is required to be set at 125 cc to 150 cc (between the broken lines in FIG. 10), the rotation speed of the stirring/conveying member 42 may be changed so that the difference between the sensor output values falls within a range of 0.11 V to 0.16 V under Condition 1 (the series of data indicated by hollow circles) and falls within a range of 0.20 V to 0.27 V under Condition 2 (the series of data indicated by hollow squares), and excessive developer may be discharged from the developer discharge portion 22*h*.

It is also possible to calculate the stable volume of developer under any conditions other than Conditions 1 and 2. As parameters associated with the flowability of developer, three parameters, namely the absolute humidity [g/m], the toner concentration in developer [%], and the number of printed sheets, are set. The difference $V_A$ between the sensor output values under a given condition (Condition A) can be calculated by the following formula (1).

$$V_A=V_2-(V_2-V_1)\{(H_2-H_A)/(H_2-H_1)\times a_H+(C_2-C_A)/(C_2-C_A)\times a_C+(L_2-L_A)/(L_2-L_1)\times a_L\} \quad (1)$$

where $V_k$ is the difference between the sensor output values under Condition k (k=1, 2, A), $H_k$ is the absolute humidity under Condition k (k=1, 2, A), $C_k$ is the toner concentration in developer under Condition k (k=1, 2, A), $L_k$ is the number of printed sheets under Condition k (k=1, 2, A), $a_H$ is the degree of contribution of the absolute humidity, $a_C$ is the degree of contribution of the toner concentration in developer, and $a_L$ is the degree of contribution of the number of printed sheets, $V_1 \le V_A \le V_2$, $C_1 \le C_A \le C_2$, $L_1 \le L_A \le L_2$, and $a_H+a_C+a_L=1$.

The relationship of the difference between the sensor output values with the stable volume of developer under Condition 1 is acquired at the start of use of the color printer 100 and is stored in the RAM 93 (or ROM 92). The relationship of the difference between the sensor output values with the stable volume of developer under Condition 2 is acquired through a preliminary test and is stored in the RAM 93 (or ROM 92) in advance. Then, based on the absolute humidity sensed by the outside temperature/humidity sensor 83 during the driving of the color printer 100, the reference toner concentration set for the developing devices 3*a* to 3*d*, and the durable number of sheets (cumulative number of printed sheets), Condition A is determined. Then, the difference between the sensor output values at which the stable volume of developer in the developer container 22 equals a predetermined amount under Condition A is calculated. Then, the rotation speed of the stirring/conveying member 42 is changed so that the difference between the sensor output values falls within a predetermined range.

Table 1 shows an example of settings under Conditions 1, 2, and A. The relationship of the stable volume of developer with the difference between the sensor output values of the first and second magnetic permeability sensors 27 and 28 under Conditions 1, 2, and A are shown in Table 2 and FIG. 11.

TABLE 1

| PARAMETER | UNIT | DEGREE OF CONTRIBUTION | CONDITION 1 | CONDITION 2 | CONDITION A |
|---|---|---|---|---|---|
| ABSOLUTE HUMIDITY | [g/m$^3$] | 0.4 | 2 | 20 | 11 |
| REFERENCE TONER CONCENTRATION | [%] | 0.4 | 6 | 10 | 8 |
| DURABLE NUMBER OF SHEETS | [sheets] | 0.2 | 0 | 300000 | 150000 |

TABLE 2

| VOLUME OF DEVELOPER [cc] | DIFFERENCE BETWEEN SENSOR OUTPUTS CONDITION 1 [V] | CONDITION 2 [V] | CONDITION A [V] |
|---|---|---|---|
| 50 | 0.00 | 0.01 | 0.005 |
| 75 | 0.03 | 0.06 | 0.045 |
| 100 | 0.07 | 0.11 | 0.090 |
| 125 | 0.11 | 0.20 | 0.155 |
| 150 | 0.16 | 0.27 | 0.215 |
| 175 | 0.20 | 0.35 | 0.275 |
| 200 | 0.26 | 0.46 | 0.360 |

Figure 11:
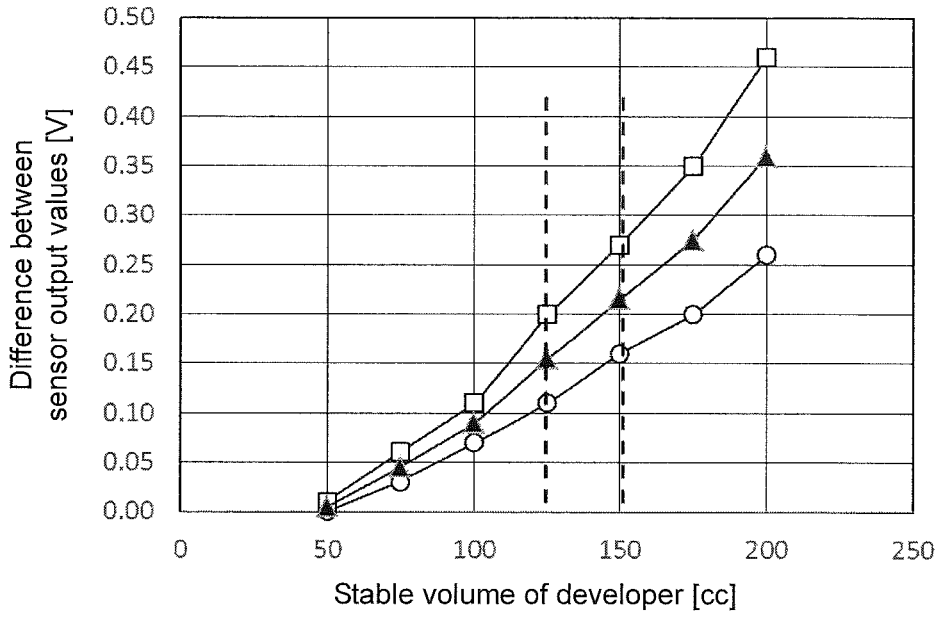
FIG. 11 is a graph showing the relationship of the stable volume of developer with the difference between the sensor output values of the first and second magnetic permeability sensors under Conditions 1, 2, and A.

As shown in Table 2 and FIG. 11, for example, in a case where the stable volume of developer is required to be set at 125 cc to 150 cc under Condition A, the difference between the sensor output values may be set so as to fall within a range of 0.155 V to 0.215 V. If the difference between the sensor output values is larger than the above range, the stable volume is above a target value. Thus, the rotation speed of the stirring/conveying member 42 is made faster for a certain period to increase the amount of developer discharged. If the difference between the sensor output values is smaller than the above range, the stable volume is below a target value. Thus, the rotation speed of the stirring/conveying member 42 is made slower for a certain period to decrease the amount of developer discharged.

In this way, by changing the rotation speed of the stirring/conveying member 42 for only a certain period based on the difference between the output values of the first and second magnetic permeability sensors 27 and 28, the stable volume of developer in the developer container 22 can be maintained in a predetermined range.

When the amount of change in the difference between the sensor output values of the first and second magnetic permeability sensors 27 and 28 with respect to the amount of change in the stable volume under Condition 1 (the gradient of the graph of Condition 1) is too large, the graphs of Conditions 1 and 2 in FIG. 11 become too close to each other. This makes it difficult to set the stable volume of developer accurately based on the difference between the sensor output values under Condition A.

To cope with that, when the amount of change in the difference between the sensor output values of the first and second magnetic permeability sensors 27 and 28 with respect to the amount of change in the stable volume under Condition 1 exceeds a predetermined value, the reference toner concentration is decreased by a control signal from the control portion 90, and the relationship of the difference between the sensor output values with the stable volume under Condition 1 is acquired again, which is then stored in RAM 93 (or ROM 92) in an overwriting manner. This decreases the flowability of developer under Condition 1, and thus the amount of change in the differences between the sensor output values with respect to the amount of change in the stable volume decreases. Thus, in FIG. 11, the graphs of Conditions 1 and 2 separate from each other to some extent, and thus the stable volume of developer under Condition A can be set accurately.

However, the reference toner concentration is a factor related to developability of an electrostatic latent image, and thus the reference toner concentration needs to be reduced within such a range as not to degrade the developability too much.

The embodiment described above is in no way meant to limit the present disclosure, which thus allows for many modifications and variations within the spirit of the present disclosure. Although the above embodiment deals with the developing devices 3*a* to 3*d* provided with the magnetic roller 21 and the developing roller 20 as shown in FIG. 2, this is not meant to be any limitation. The present disclosure is applicable to various developing devices which use two-component developer containing toner and carrier, such as those which, for example, Include no developing roller 20 and which instead form a magnetic brush on the magnetic roller 21 and put it into contact with the photosensitive drums 1*a* to 1*d* to develop electrostatic latent images.

In the above embodiments, in order to retain developer on the upstream side of the developer discharge portion 22*h*, the regulating portion 52 composed of a helical blade having the phase opposite to that of the second helical blade and the disk 55 are provided on the second stirring screw 44, but the structure for retaining developer is not limited to this. For example, the disk 55 may be omitted and only the regulating portion 52 may be provided, or the regulating portion 52 and a plurality of discs 55 may be combined, or the regulating portion 52 may be composed only of a plurality of discs.

The present disclosure is applicable not only to tandem-type color printers such as the one shown in FIG. 1, but also to various types of image forming apparatuses using two-component development system such as digital and analogue monochrome copiers, monochrome printers, color copiers, and facsimile machines.

The present disclosure is applicable to a developing device which supplies two-component developer containing toner and carrier and discharges excessive developer, as well as an mage forming apparatus provided with such a developing device. Based on the present disclosure, it is possible to provide a developing device which can reduce the amount of change in the height and weight of developer in the developer container even if the flowability and conveyance speed of developer change.

What is claimed is:

1. A developing device comprising:

a developer container including a plurality of conveying chambers having a first conveying chamber and a second conveying chamber which are arranged parallel to each other, a communication portion which makes the first and second conveying chambers communicate with each other at both ends of the first and second conveying chambers in a longitudinal direction, a developer supply port through which two-component developer containing carrier and toner is supplied, and a developer discharge portion which is provided at a downstream-side end part of the second conveying chamber and through which excessive developer is discharged;

a developer carrier which is rotatably supported on the developer container and which carries, on a surface thereof, developer in the second conveying chamber;

a first stirring/conveying member which is composed of a rotary shaft and a first conveying blade formed on an outer circumferential surface of the rotary shaft and which stirs and conveys developer in the first conveying chamber in a first direction;

a second stirring/conveying member which stirs and conveys developer in the second conveying chamber in a second direction opposite to the first direction, including a rotary shaft, a second conveying blade which is formed on an outer circumferential surface of the rotary shaft, a regulating portion which is formed adjacent to the second conveying blade on a downstream side thereof in the second direction and which is composed of a conveying blade for conveying developer in a direction opposite to the second conveying blade, and a discharging blade which is formed adjacent to the regulating portion on a downstream side thereof in the second direction and which conveys developer in a same direction as the second conveying blade and which discharges developer from the developer discharge portion;

a driving motor which drives the first stirring/conveying member and the second stirring/conveying member;

a first magnetic permeability sensor which is arranged in the first conveying chamber, in a region other than a part thereof facing the communication portion and which senses a toner concentration in developer in the developer container;

a second magnetic permeability sensor which is arranged in the second conveying chamber, in a region between the regulating portion and a downstream-side end part of the developer carrier in the second direction; and a control portion which controls the amount of developer supplied from the developer supply port based on an output value of the first magnetic permeability sensor so that the toner concentration in the developer in the developer container equals a reference toner concentration, the control portion calculating a stable volume of developer in the developer container based on a difference between output values of the first magnetic permeability sensor and the second magnetic permeability sensor.

2. The developing device according to claim 1, wherein the control portion maintains the stable volume within a predetermined range by controlling the driving motor based on a calculation result of the stable volume and thereby adjusting rotation speed of the first stirring/conveying member and the second stirring/conveying member.

3. An image forming apparatus comprising an image forming portion which includes an image carrier on which an electrostatic latent image is formed, and the developing device according to claim 1 which develops the electrostatic latent image formed on the image carrier into a toner image, the image forming portion forming an image on a recording medium.

4. The image forming apparatus according to claim 3, comprising:

a humidity sensing device which senses an absolute humidity; and a number-of-printed-sheets counting portion which counts a number of printed sheets, wherein the control portion which calculates, using as parameters an absolute humidity sensed by the humidity sensing device, a toner concentration in the developer sensed by the first magnetic permeability sensor, and a cumulative number of printed sheets counted by the number-of-printed-sheets counting portion and based on a relationship, with the stable volume, of differences between the output values under a condition where flowability of the developer is relatively low and under a condition where the flowability of the developer is relatively high, the relationship, with the stable volume, of the difference between the output values under a condition where the flowability of the developer equals a predetermined amount.

5. The image forming apparatus according to claim 4, wherein when the condition where the flowability of the developer is relatively low is Condition 1, the condition where the flowability of the developer is relatively higher than under Condition 1 is Condition 2, and the condition where the flowability of the developer equals the predetermined value is Condition A, the control portion calculates the difference between the output values under Condition A by a following formula (1), $$V_A=V_2-(V_2-V_1)\{(H_2-H_A)/(H_2-H_1)\times a_H+(C_2-C_A)/(C_2-C_1)\times a_C(L_2-L_A)/(L_2-L_1)\times a_L\} \quad (1)$$

where $V_k$ is the difference between sensor output values under Condition k (k=1, 2, A), $H_k$ is the absolute humidity under Condition k (k=1, 2, A), $C_k$ is the toner concentration in the developer under Condition k (k=1, 2, A), $L_k$ is the number of printed sheets under Condition k (k=1, 2, A), $a_H$ is a degree of contribution of the absolute humidity, $a_C$ is a degree of contribution of the toner concentration in the developer, and $a_L$ is a degree of contribution of the number of printed sheets, $V_1 \leq V_A \leq V_2$, $C_1 \leq C_A \leq C_2$, $L_1 \leq L_A \leq L_2$, and $a_H+a_C+a_L=1$.

6. The image forming apparatus according to claim 4, comprising a storage portion in which the relationship, with the stable volume, of the differences between the output values under Conditions 1 and 2 is stored in advance, wherein when an amount of change in the difference between the output values with respect to an amount of change in the stable volume under Condition 1 is larger than a predetermined amount, the control portion reduces the toner concentration in the developer and acquires a relationship, with the stable volume, of the difference between the output values under Condition 1 again.

* * * * *